United States Patent [19]

Sherrow

[11] Patent Number: 4,570,545

[45] Date of Patent: Feb. 18, 1986

[54] CONNECTING MEANS FOR A STANCHION IN A RAILWAY CAR

[75] Inventor: Lionel Sherrow, Huntingdon Valley, Pa.

[73] Assignee: The Budd Company, Troy, Mich.

[21] Appl. No.: 533,389

[22] Filed: Sep. 19, 1983

[51] Int. Cl.[4] ..... B61D 17/00

[52] U.S. Cl. ..... 105/354; 105/345; 105/397; 403/167; 403/343

[58] Field of Search ..... 105/397, 322, 324, 326, 105/345, 354, 461, 346; 52/22, 238, 39, 45; 248/56; 403/167, 296, 343

[56] References Cited

U.S. PATENT DOCUMENTS

| | | | |
|---|---|---|---|
| 400,066 | 3/1889 | Enequist | 105/345 |
| 1,098,250 | 5/1914 | Gonia | 52/39 |
| 1,431,513 | 10/1922 | Cox | 403/296 |
| 2,502,320 | 3/1950 | Guernsey | 105/397 |
| 3,630,566 | 12/1971 | Barecki | 105/345 |

FOREIGN PATENT DOCUMENTS

| | | | |
|---|---|---|---|
| 1023491 | 3/1953 | France | 105/322 |

*Primary Examiner*—Robert B. Reeves
*Assistant Examiner*—Dennis C. Rodgers
*Attorney, Agent, or Firm*—Edward M. Farrell; Herman Foster; T. I. Davenport

[57] ABSTRACT

A stub post is connected between the roof and ceiling of a railway car. A stanchion is fixed to the stub post and slip fitted into a cup secured to the top of an aisle seat. An adapter unit attached to the stub post is provided to receive the top end of the stanchion and permit it to be pivoted in position to drop into the cup member before it is fixed in place to the adapter.

12 Claims, 4 Drawing Figures

CONNECTING MEANS FOR A STANCHION IN A RAILWAY CAR

BACKGROUND OF THE INVENTION

Stanchions, including those supporting handrails, have been used in railway cars for many years. The stanchions and handrails permit passengers, who have to stand, to grip them for support while the car is moving.

In order to provide maximum passenger comfort as well as attractive interiors, modern railway cars have included conveniences such as improved heating, air conditioning and lighting. In view of the many changes in the interior of the car, conventional locations and connections of the stanchions are not always possible.

In many modern cars, a combination fluorescent lighting fixture and diffuser is optimally located above the exact center of two passenger seats. They, therefore, require a wide ceiling duct encompassing these fixtures to be built into the center ceiling of the car.

Stanchions which are designed to be attached to aisle seats must penetrate the ceiling, which may also serve as the bottom panel of a duct, and ultimately achieve a hard connection with the roof in order to acquire the strength and rigidity it requires.

Some modern cars include cantilevered aisle seats which are connected to the side walls of the car with no supports being provided beneath the seats. In cases where the stanchions are to be connected between the seats and ceiling, the load on the stanchions and handrails must be completely transferred to the roof of the car without stressing the seats which are not designed to accommodate additional loads.

Because of the need to obtain access to components behind the ceiling, such as the lighting and air conditioning fixtures, it is desirable to provide stanchions which are assembled and disassembled without disturbing the seat or other connections in the car.

OBJECTS OF THE INVENTION

It is an object of this invention to provide an improved means for connecting a stanchion in a railway car between a free standing aisle seat and the ceiling and roof.

It is a further object of this invention to provide an improved means for assembling and disassembling a stanchion post without disturbing other parts of the interior of the railway car.

It is still a further object of this invention to provide an improved means for connecting a stanchion between a seat and the ceiling without the use of relatively heavy structural beams above the ceiling panel to permit the stanchion to be attached thereto.

BRIEF SUMMARY OF THE INVENTION

In accordance with the present invention, a stub post is secured between the roof and ceiling of a railway car. A cantilevered aisle seat extending from the side wall of the car includes a cup member attached thereto. A stanchion is connected to the stub post through an adapter unit and slide fitted into the cup member. The assembling of the stanchion involves first sliding into the loosely connected adapter unit and then pivoting it into a vertical position so that it can drop into the cup member. With the stanchion in position, and adapter torqued tight, the stanchion is fixedly secured to the adapter used. The stanchion may be assembled and disassembled without disturbing the seat or other parts inside the car.

Other objects and advantages of the present invention will be apparent and suggest themselves to those skilled in the art from a reading of the following specification and claims, taken in conjunction with the accompanying drawings.

DESCRIPTION OF THE INVENTION

Figure 1:
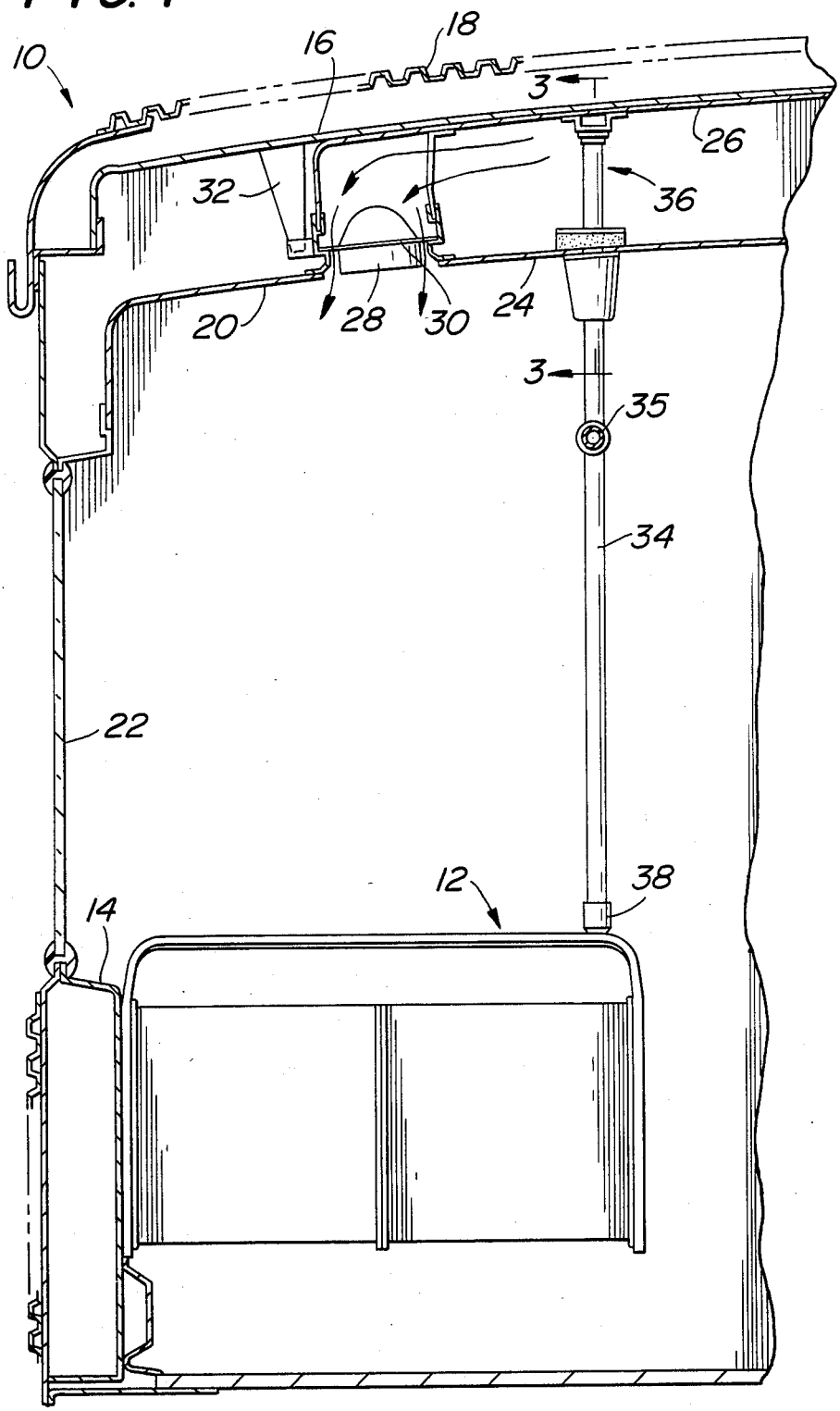
FIG. 1 is a view, partly in cross-section, illustrating a stanchion in a railway car, in accordance with the present invention.

Referring particularly to FIG. 1, the interior of a railway car 10 includes an aisle seat 12 connected to a sidewall 14. The bottom of the aisle seat 12 is free of any supporting means.

The car 10 includes a roof 16 which may include a corrugated cover 18. A member 20 includes a pair of bent sections to form part of a side ceiling and part of the sidewall. A window 22 is connected between the sidewall assembly 14 and the top portion of the interior of the car including the member 20. All of the elements mentioned thus far are conventional and well known to those skilled in the art. Because of this, these and many of the other elements illustrated will not be described in detail because the present invention is primarily directed to means associated with the stanchion connections and parts associated therewith, which will be described in greater detail.

In the embodiment illustrated, a combination fluorescent lighting fixture and diffuser for air conditioned air is located above the center of the two passenger aisle seat 12. The other side of the aisle in the railcar (not illustrated) provide basically the same arrangement as that illustrated in FIG. 1. Because of the arrangement illustrated, it is necessary that a wide ceiling duct encompassing the fluorescent fixtures and diffusers be built into the center ceiling 24 of the railcar.

An air conditioning duct 26 extends along the length of the car. As mentioned, it is relatively wide so that the air may be directed downwardly toward the center of the aisle seats. The center ceiling 24 provides the bottom portion for the air duct. Fluorescent lights 28 are suitably mounted to member 30. The member 30 includes a plurality of spaced openings to permit the air generated in the duct 26 to be diffused or directed downwardly as indicated by the arrows. Suitable hangers, such as hanger 32, are secured to the roof 16 to support the attachment member 30.

In the embodiment illustrated, a stanchion 34, which carries a handrail 35, must be attached to the seat 12 on its aisle side and must penetrate the center ceiling panel 24, which is the bottom wall of the air duct 26 and ultimately achieve a hard connection with the roof 16 in order to acquire the strength and rigidity it requires.

To effect this, a stub post assembly 36, to be described in detail in connection with subsequent figures, is mounted to the roof 16 through the top wall of the duct 26 prior to the assembly of the ceiling center panels 24. At the base of the stub post assembly 36, to be described, means are provided to permit attachment of the stanchion 34 and to provide sealing off of the air duct 26.

In the embodiment illustrated, after the stub post assembly 36 has been installed, the center ceiling panel 24 is mounted. Following this, the stanchion is fixedly connected to the stub post assembly 36 and slidably installed in a cup member 38 which is permanently attached to the top of the seat 12. The present invention, as mentioned previously, involves the stanchion post 24 and the various means to which it is connected to permit a firm connection to the roof 16 while still not permitting any stresses to be developed on the seat 12.

Figure 2:
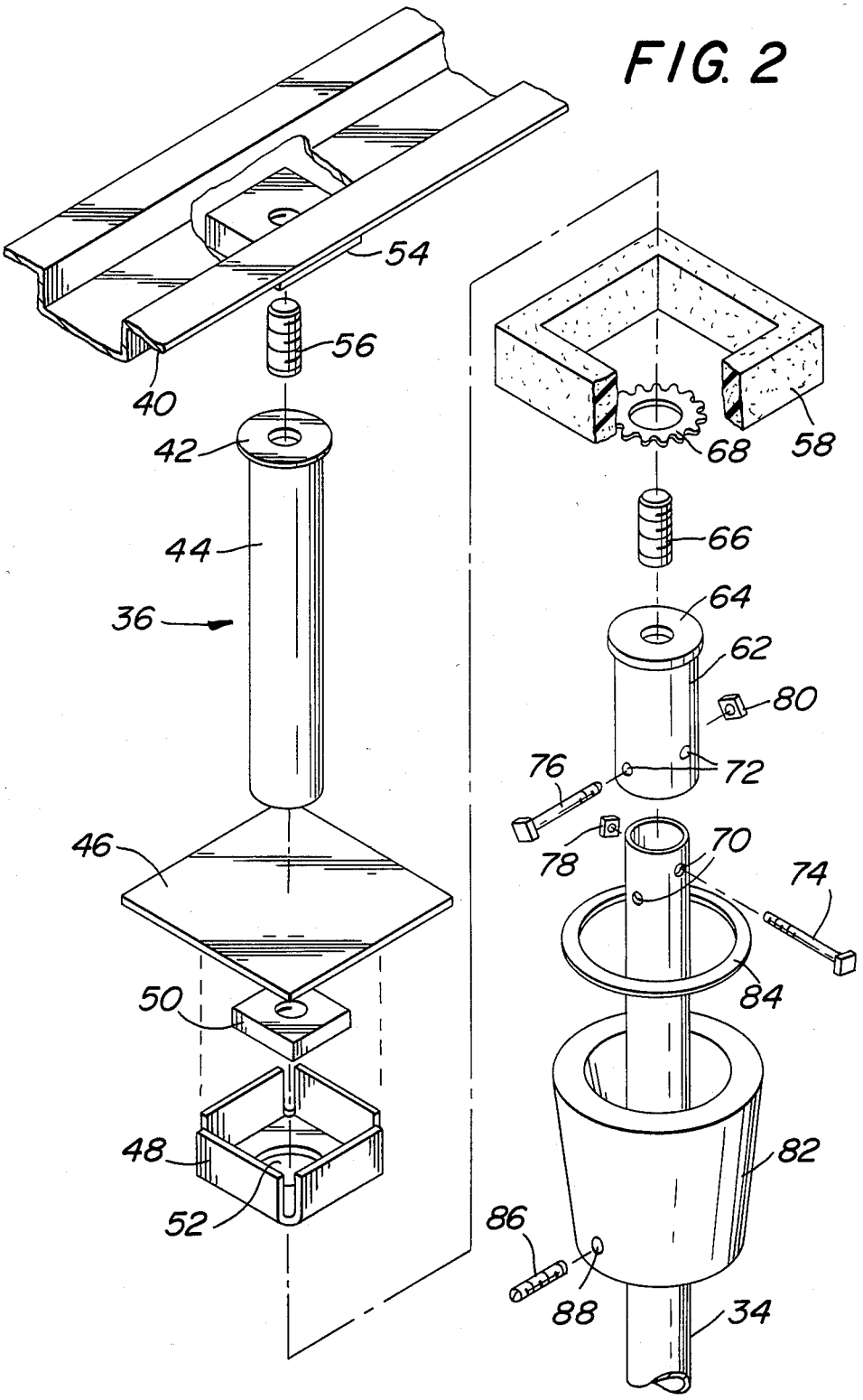
FIG. 2 is an exploded view illustrating the elements for connecting the stanchion between the seat and roof of the car, in accordance with the present invention.
Figure 3:
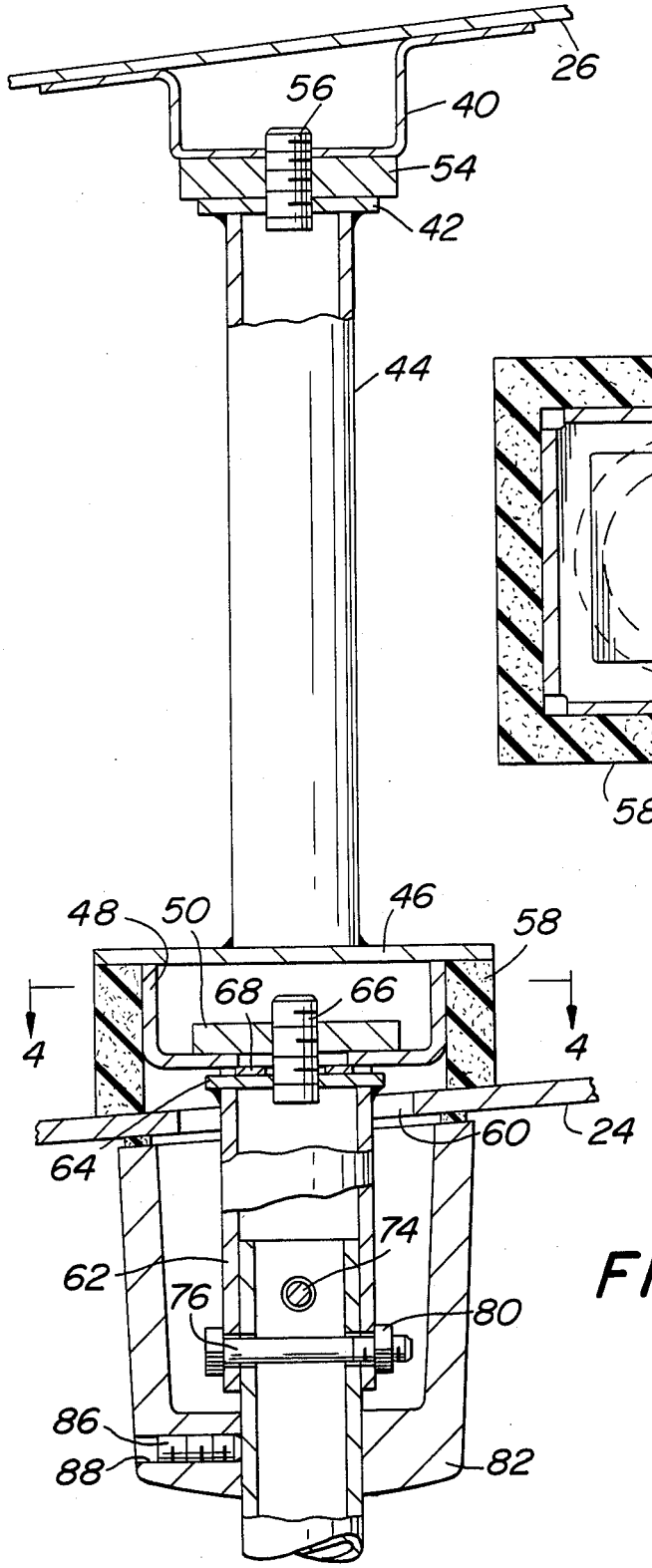
FIG. 3 is a cross-sectional view taken along lines 3—3 of FIG. 1.
Figure 4:
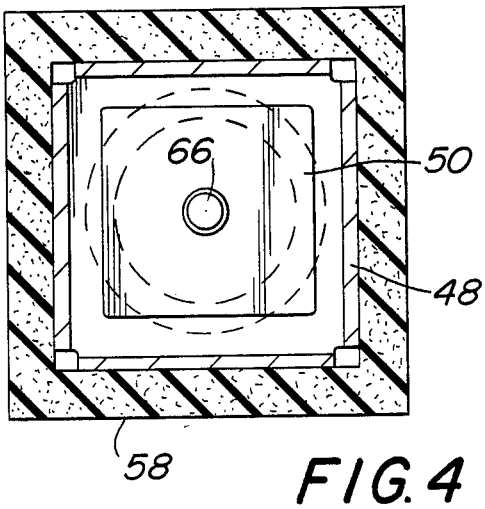
FIG. 4 is a cross-sectional view taken along lines 4—4 of FIG. 3.

Referring to FIGS. 2, 3 and 4, a hat section 40 extending longitudinally along the car and is attached at appropriate locations to the carlines of the car. The stub post assembly 36 includes a top threaded element 42 which may include means to be inserted into a tubular post 44, or, alternatively, the member 42 may be welded to the top of the tubular member 44. The bottom portion of the tubular member 44 is welded to a plate 46. A box 48 is welded to the bottom portion of the plate 46 with a nut 50 being disposed within the box 48. It is noted that the plate 48 includes a centrally disposed opening 52. A tapping block 54 may be welded to the hat section 40 and threaded to receive a nut 56 therein. The stub post assembly 36 is secured to the tapping block 54 and hat section 40 by means of the element 42 threadedly engaging the screw 56 which is also connected in the tapping block 54. A foam rubber or other flexible foam sleeve 58 is secured around the box 48 to prevent air from passing from the air conditioning duct 26 through the opening 60 in the ceiling 24.

As mentioned, the stub post assembly described is generally installed first in the proper position. The ceiling 24 is then installed with the opening 60 therein. Following these installations, the stanchion 34 is installed between the stub post assembly 36 and the cup member 38 of the aisle seat 12.

After the ceiling 24 has been installed, a tubular adapter member 62 which includes a top threaded element 64 secured thereto, is attached to the stub post assembly 36. A tight fitting screw 66 is threadedly connected to the element 64. The screw 66 is then connected to the nut 50 within the box 48. A lock washer 68 is connected between the element 64 and the bottom of the plate of the box 48.

A feature of the present invention involves the manner in which the adapter or sleeve member 62 is connected to the nut 50 within the box 48. The nut 50 is relatively large and fits into the box 48 so that it cannot be freely rotated within the box without the corner edges of the nut contacting the inner walls of the box 48. The box 48 includes a relatively large opening 52 so that the screw 66 connected to the element 64 may be easily inserted into the threaded portion 50 because of the wide tolerances provided by the openings 52. It is unlikely, due to tolerance build up, that any installations will involve exact alignment between the cup on the seat and the bottom of the stub post. The large opening 52 and floating nut 50 make it possible to compensate for this misalignment. When the adapter unit 62 is rotated during installation, the screw 66 tightly engages the nut 50. Thus before the adapter unit is fully tightened in place, however, it is necessary to position the stanchion 34 so it is perfectly vertical.

During installation of the stanchion, the adapter unit 62 is loosened from the nut 50 within the box 48. The length of the stanchion 34 is dimensioned so that it does not extend completely into the tubular adapter member 62, but is free to move to different heights therein. When the adapter unit 62 is loosened from the captive nut 50 and the stanchion 34 slid into the adapter (i.d. of stanchion and o.d. of adapter is such that stanchion slides in adapter) unit 62, the stanchion 34 may be pivoted and raised slightly to permit its bottom end to be inserted into the cup member 38. After the stanchion 34 is inserted in the cup member 38, the adapter unit 62 may be tightened into place with the screw 66 tightly engaging the nut 50 within the box 48. At this time, the final steps in the installation of the stanchion 34 may take place.

With the stanchion 34 positioned between the adapter 62 and the cup member 38, it may be lifted slightly to permit apertures 70 within the stanchion 34 to be aligned with apertures 72 in the adapter unit 62. The length of the stanchion 34 is dimensioned so that this is accomplished without the bottom end of the stanchion 34 leaving the cup member 38.

Additional apertures are disposed on opposite sides of the apertures 70 and 72 and are not illustrated. When the apertures 70 and 72 are aligned, screws 74 and 76, respectively, may be inserted through the apertures to engage nuts 78 and 80, respectively. When the screws are tightened to the nuts, the assembly of the stanchion 34 is completed.

After the stanchion 34 has been attached, a finishing cup 82, originally surrounding the stanchion 34 prior to the installation process, is moved up toward the ceiling 24 to cover the adapter unit 62 and its associated connections. A gasket 84 is provided between the finishing cup 82 and the ceiling 24. After the finishing cup 82 is in position, it is held in position by means of the insertion of a screw 86 through an opening 88. The stanchion 34 may include another opening to receive the end portion of the screw 86.

The reverse process of disassembling the stanchion 34 involves loosening the screw 86 and lowering the finishing cup 82. The screws 74 and 76 are then disconnected from the nuts 78 and 80. The stanchion 34 is now free to move up and down within the adapter unit 62. The adapter unit 62 is now loosened from the captive nut 54 to permit some pivoted movement of the stanchion after it is lifted out of the cup member 38.

The present invention has therefore provided means for easily assembling and disassembling a stanchion 34 from a railcar without disturbing other connections within the car. The stanchion provided is slip fitted to the aisle seat without putting excessive stresses thereon. At the same time, the stanchion 34 is firmly fixed to the roof which receives all the downward stresses resulting from the passengers gripping the stanchion or handrails.

The present invention also provides means for compensation for slight misalignments of the cup member on the seat and the stub post between the ceiling and roof. This is accomplished by the relatively large opening 52 in the box 48 and floating nut 50.

What is claimed is:

1. In combination with a railway car having a spaced roof and a ceiling having an opening to receive connecting elements therethrough, and a seat inside said car, connecting means for connecting a stanchion from said seat to said ceiling comprising:

(a) a stub post assembly connected between said roof and said ceiling;

(b) means secured to said seat to receive the bottom end of said stanchion;

(c) said seat being connected to and extending freely from a side wall of said car and unsupported by said stanchion, and (d) adjustment means including an adapter unit attached to said stub post to receive the top end of said stanchion and permit it to be pivoted into position with respect to said seat and for securing said stanchion to said stub post assembly adjacent said ceiling.

2. Connecting means as set forth in claim 1 wherein said means for securing said seat includes a cup member.

3. Connecting means as set forth in claim 2 wherein said stanchion is disposed within said cup member.

4. Connecting means as set forth in claim 3 wherein a tubular adapter member is connected to said stub post assembly and dimensioned to receive therein said stanchion.

5. Connecting means as set forth in claim 4 wherein said tubular adapter member includes a screw for connection to said stub post assembly.

6. Connecting means as set forth in claim 5 wherein said stub post assembly includes a box structure having an opening therein and a nut to receive said screw on said tubular adapter member when it is inserted through said opening.

7. In combination with a railway car having a spaced roof and a ceiling having an opening to receive connecting elements therethrough, and a seat connected to and extending freely from a sidewall of said car, connecting means for connecting a stanchion from said seat to said ceiling comprising:

(a) a stub post assembly connected between said roof and said ceiling;

(b) a cup member for securing said seat to receive the bottom end of said stanchion therein;

(c) a tubular adapter connected to said stub post assembly adjacent said ceiling and dimensioned to receive said stanchion therein;

(d) said tubular adapter member including a screw for connection to said stub post assembly;

(e) said stub post assembly including a box structure having an opening therein and a nut to receive said screw on said tubular adapter member when it is inserted through said opening; and (f) said nut being loosely fitted in said box and said opening is larger than said screw to permit said adapter member with said stanchion to be lifted from said cup member and pivoted away threfrom during the assembly and disassembly of said stanchion.

8. Connecting means as set forth in claim 7 wherein means are provided to fix said stanchion to said adapter member after it has been placed in said cup member during the assembly of said stanchion.

9. Connecting means as set forth in claim 8 wherein said stub post assembly connected between said roof and said ceiling is disposed within an air conditioning duct which includes said ceiling as its bottom wall.

10. Connecting means as set forth in claim 9 wherein sealing means are provided around said stub post assembly to prevent air from escaping from said duct through the opening in said ceiling.

11. Connecting means as set forth in claim 10 wherein said stub post assembly includes a threaded member and a tubular element connected between a connecting plate secured to said box and said threaded member.

12. Connecting means as set forth in claim 11 wherein said top connecting plate of said stub post assembly is mounted to a hat section secured to the carline of said railway car.

* * * * *